US009676596B2

(12) United States Patent
Yoshikawa et al.

(10) Patent No.: US 9,676,596 B2
(45) Date of Patent: Jun. 13, 2017

(54) ELEVATOR REFURBISHING METHOD

(71) Applicants: Kazuhiro Yoshikawa, Chiyoda-ku (JP); Hideki Miyahara, Chiyoda-ku (JP); Kazuhiro Sasaki, Chiyoda-ku (JP); Yoshinao Takahashi, Chiyoda-ku (JP)

(72) Inventors: Kazuhiro Yoshikawa, Chiyoda-ku (JP); Hideki Miyahara, Chiyoda-ku (JP); Kazuhiro Sasaki, Chiyoda-ku (JP); Yoshinao Takahashi, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 12 days.

(21) Appl. No.: 14/761,199

(22) PCT Filed: Mar. 4, 2013

(86) PCT No.: PCT/JP2013/055815

§ 371 (c)(1),
(2) Date: Jul. 15, 2015

(87) PCT Pub. No.: WO2014/136171

PCT Pub. Date: Sep. 12, 2014

(65) Prior Publication Data

US 2015/0336771 A1 Nov. 26, 2015

(51) Int. Cl.
*B66B 19/00* (2006.01)

(52) U.S. Cl.
CPC ..... *B66B 19/007* (2013.01); *B66B 19/002* (2013.01); *B66B 19/005* (2013.01)

(58) Field of Classification Search
CPC ... B66B 19/002; B66B 19/005; B66B 19/007; B66B 11/0045; B66B 11/008;
(Continued)

(56) References Cited

U.S. PATENT DOCUMENTS 5,899,301 A * 5/1999 Aulanko ..... B66B 11/0438 187/254
6,471,012 B2 * 10/2002 Faletto ..... B66B 11/008 187/256

(Continued)

FOREIGN PATENT DOCUMENTS

JP 2009-196786 A 9/2009
JP 2010-215299 A 9/2010

(Continued)

OTHER PUBLICATIONS

Japanese Office Action issued Jan. 5, 2016 in Patent Application No. 2015-504015 (with English Summary).

(Continued)

*Primary Examiner* — James Ference
(74) *Attorney, Agent, or Firm* — Oblon, McClelland, Maier & Neustadt, L.L.P.

(57) ABSTRACT

In an elevator refurbishing method in which a hydraulic elevator in which a hydraulic jack is installed in an equipment installation zone is refurbished into a machine-room-less elevator that uses a two-to-one (2:1) roping method, the equipment installation zone being a region inside a hoistway on either a left side or a right side of a car when viewed from directly above, at least one guide rail from a pair of counterweight guide rails is installed in the equipment installation zone while leaving the hydraulic jack in position, the hydraulic jack is removed from the hoistway, the hoisting machine is installed in a lower portion of the equipment installation zone using a space that is created by removal of the hydraulic jack, and a car return sheave and a counterweight return sheave are installed on an upper portion of the counterweight guide rails.

8 Claims, 6 Drawing Sheets

(58) Field of Classification Search
CPC ... B66B 11/08; B66B 11/0055; B66B 11/007; B66B 7/027; B66B 7/021; B66B 9/04
See application file for complete search history.

(56) References Cited

U.S. PATENT DOCUMENTS 6,655,500 B2 * 12/2003 Orrman ..... B66B 11/008 187/254
6,991,069 B1 * 1/2006 Ach ..... B66B 7/027 187/254
2003/0024772 A1 * 2/2003 Naitoh ..... B66B 1/42 187/401
2005/0217943 A1 * 10/2005 Heggli ..... B66B 7/021 187/266
2005/0217944 A1 * 10/2005 Aulanko ..... B66B 7/02 187/266
2009/0133965 A1 * 5/2009 Mattila ..... B66B 5/0031 187/288
2010/0012436 A1 * 1/2010 Block, Jr. ..... B66B 9/04 187/261
2012/0145489 A1 * 6/2012 Tian ..... B66B 19/005 187/406
2015/0336771 A1 * 11/2015 Yoshikawa ..... B66B 19/007 52/741.1

FOREIGN PATENT DOCUMENTS

JP 2011-20804 A 2/2011
JP 2011-68438 A 4/2011
JP 2011-251826 A 12/2011
JP 2012-224414 A 11/2012
JP 2012-240801 A 12/2012

OTHER PUBLICATIONS

International Search report issued Apr. 9, 2013 in PCT/JP2013/055815 filed Mar. 4, 2013.

* cited by examiner

ELEVATOR REFURBISHING METHOD

TECHNICAL FIELD

The present invention relates to an elevator refurbishing method by which a hydraulic elevator is refurbished into a machine-roomless elevator that uses a two-to-one (2:1) roping method.

BACKGROUND ART

In conventional elevator refurbishing methods, a pair of counterweight guide rails are installed behind a car hoisting zone inside a hoistway so as to line up with an existing hydraulic jack. A supporting beam is installed in an upper portion of the hoistway directly above the hydraulic jack. A hoisting machine is installed on top of this supporting beam. After refurbishing, the hydraulic jack remains inside the hoistway (see Patent Literature 1 and 2, for example).

CITATION LIST

Patent Literature

[Patent Literature 1]
Japanese Patent Laid-Open No. 2010-215299 (Gazette)
[Patent Literature 2]
Japanese Patent Laid-Open No. 2011-20804 (Gazette)

SUMMARY OF THE INVENTION

Problem to be Solved by the Invention

In conventional elevator refurbishing methods such as those described above, because it is necessary to lift the hoisting machine, which is a heavy load, to the upper portion of the hoistway, it is necessary to install a large lifting beam in the upper portion of the hoistway, increasing the scale of construction work, and making the construction work time-consuming. Top portion dimensions of the hoistway are also reduced, sometimes making it impossible to install the hoisting machine.

The present invention aims to solve the above problems and an object of the present invention is to provide an elevator refurbishing method that can reduce labor time for the refurbishing work.

Means for Solving the Problem

In order to achieve the above object, according to one aspect of the present invention, there is provided an elevator refurbishing method in which a hydraulic elevator in which a hydraulic jack is installed in an equipment installation zone is refurbished into a machine-roomless elevator that uses a two-to-one (2:1) roping method that includes a hoisting machine, a counterweight, and a pair of counterweight guide rails, the equipment installation zone being a region inside a hoistway on either a left side or a right side of a car when viewed from directly above, wherein the elevator refurbishing method includes steps of: installing at least one guide rail from the pair of counterweight guide rails in the equipment installation zone while leaving the hydraulic jack in position; removing the hydraulic jack from the hoistway; installing the hoisting machine in a lower portion of the equipment installation zone using a space that is created by removal of the hydraulic jack; and installing a car return sheave and a counterweight return sheave on an upper portion of the counterweight guide rails.

According to another aspect of the present invention, there is provided an elevator refurbishing method in which a hydraulic elevator in which a hydraulic jack and a pair of hydraulic jack rails are installed in an equipment installation zone is refurbished into a machine-roomless elevator that uses a two-to-one (2:1) roping method that includes a hoisting machine, a counterweight, and a pair of counterweight guide rails, the equipment installation zone being a region inside a hoistway on either a left side or a right side of a car when viewed from directly above, wherein the elevator refurbishing method includes steps of: installing the hoisting machine in a lower portion of the equipment installation zone while leaving the hydraulic jack in position; removing the hydraulic jack from the hoistway; and using the hydraulic jack rails as the counterweight guide rails, disposing the counterweight between the hydraulic jack rails, and installing a car return sheave and a counterweight return sheave on an upper portion of the hydraulic jack rails.

According to yet another aspect of the present invention, there is provided an elevator refurbishing method in which a hydraulic elevator in which a hydraulic jack is installed in an equipment installation zone is refurbished into a machine-roomless elevator that uses a two-to-one (2:1) roping method that includes a hoisting machine, a counterweight, and a pair of counterweight guide rails, the equipment installation zone being a region inside a hoistway on either a left side or a right side of a car when viewed from directly above, wherein the elevator refurbishing method includes steps of: installing the hoisting machine in a lower portion of the equipment installation zone while leaving the hydraulic jack in position; removing the hydraulic jack from the hoistway; installing the counterweight guide rails in the equipment installation zone, and disposing the counterweight between the counterweight guide rails, using a space that is created by removal of the hydraulic jack; and installing a car return sheave and a counterweight return sheave on an upper portion of the counterweight guide rails.

Effects of the Invention

In the elevator refurbishing method according to the present invention, because it is not necessary to lift the hoisting machine to the upper portion of the hoistway, the scale of the work is reduced, and labor time in the refurbishing work can also be reduced.

DESCRIPTION OF EMBODIMENTS

Preferred embodiments of the present invention will now be explained with reference to the drawings.

Embodiment 1

Figure 1:
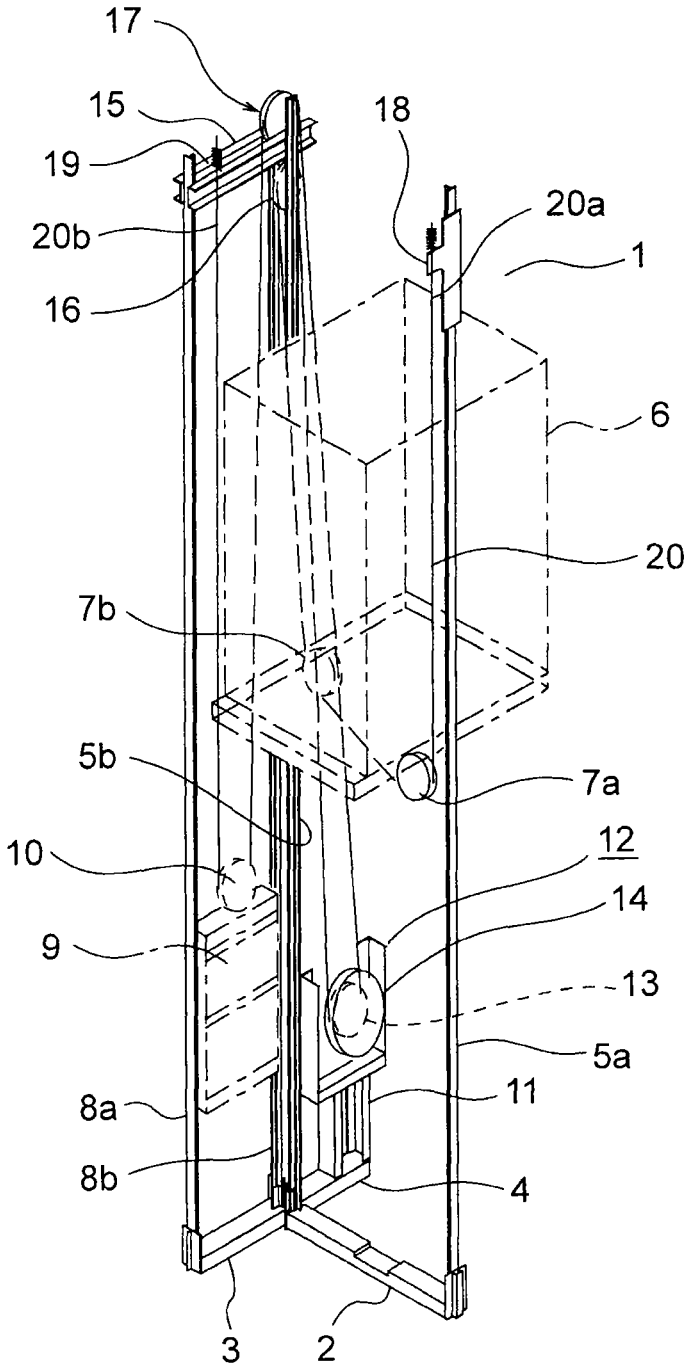
FIG. 1 is an oblique projection that shows a machine-roomless elevator that has been refurbished by a refurbishing method according to Embodiment 1 of the present invention.

FIG. 1 is an oblique projection that shows a machine-roomless elevator that has been refurbished by a refurbishing method according to Embodiment 1 of the present invention. First through third bases 2 through 4 are fixed to a floor surface in a bottom portion of a hoistway 1.

A pair of (first and second) car guide rails 5*a* and 5*b* are installed above the first base 2 so as to be parallel to each other and vertical. A car 6 is disposed between the car guide rails 5*a* and 5*b*, and is raised and lowered inside the hoistway 1 so as to be guided by the car guide rails 5*a* and 5*b*. A pair of (first and second) car suspending sheaves 7*a* and 7*b* are disposed on a lower portion of the car 1.

A pair of (first and second) counterweight guide rails 8*a* and 8*b* are installed above the second base 3 so as to be parallel to each other and vertical. A counterweight 9 is disposed between the counterweight guide rails 8*a* and 8*b*, and is raised and lowered inside the hoistway 1 so as to be guided by the counterweight guide rails 8*a* and 8*b*. A counterweight suspending sheave 10 is disposed on an upper portion of the counterweight 9.

A hoisting machine 12 is installed on the third base 4 so as to have a hoisting machine base 11 interposed. The hoisting machine 12 is disposed in a lower portion inside the hoistway 1. A thin hoisting machine in which an axial dimension is smaller than dimensions that are perpendicular to an axial direction is used as the hoisting machine 12.

The hoisting machine 12 has a driving sheave 13 and a hoisting machine main body 14. Disposed on the hoisting machine main body 14 are: a hoisting machine motor that rotates the driving sheave 13; and a hoisting machine brake that brakes rotation of the driving sheave 13. A controlling board (not shown) that controls the hoisting machine 12 is installed inside the hoistway 1.

An upper portion supporting beam 15 is fixed horizontally in a vicinity of the upper end portion of the counterweight guide rails 8*a* and 8*b*. A car return sheave 16 is supported on a lower portion of the upper portion supporting beam 15. A counterweight return sheave 17 is supported on the upper portion supporting beam 15. The car return sheave 16 and the counterweight return sheave 17 face a back surface of the second car guide rail 5*b*.

A car rope fastener portion 18 is fixed in a vicinity of an upper end portion of the first car guide rail 5*a*. The car rope fastener portion 18 may alternatively be fixed to an existing rope fastener beam in an upper portion of the hoistway 1. A counterweight rope fastener portion 19 is disposed on the upper portion supporting beam 15.

The car 6 and the counterweight 9 are suspended inside the hoistway 1 by a suspending body 20, and are raised and lowered by the hoisting machine 12. A plurality of ropes or a plurality of belts are used as the suspending body 20. The suspending body 20 has: a first end portion (a car end portion) 20*a* that is connected to the car rope fastener portion 18; and a second end portion (a counterweight end portion) 20*b* that is connected to the counterweight rope fastener portion 19.

The suspending body 20 is wound from near the first end portion 20*a* sequentially around the car suspending sheaves 7*a* and 7*b*, the car return sheave 16, the driving sheave 13, the counterweight return sheave 17, and the counterweight suspending sheave 10. In other words, the car 6 and the counterweight 9 are suspended using a two-to-one (2:1) roping method.

The car guide rails 5*a* and 5*b* are disposed on left and right sides of the car 6 at an intermediate portion in a depth direction of the car 6. The counterweight guide rails 8*a* and 8*b*, the counterweight 9, the hoisting machine 12, the upper portion supporting beam 15, the car return sheave 16, and the counterweight return sheave 17 are disposed in an equipment installation zone 1*a* (FIG. 4), which is a region inside the hoistway 1 on either the left or the right side of the car when viewed from directly above (in this example, near the second car guide rail 5*b*).

When viewed from a landing side, the counterweight 9 is disposed at a front of the equipment installation zone 1*a*, and the hoisting machine 12 is disposed at a back of the equipment installation zone 1*a*. In addition, the hoisting machine 12 is disposed such that a rotating shaft of the driving sheave 13 is horizontal and parallel to a width direction of the car 6 (a lateral direction in FIG. 4). Furthermore, the hoisting machine 12 is disposed such that the hoisting machine main body 14 is positioned nearer to the hoisting zone of the car 6 than the driving sheave 13.

A straight line that connects centers of the car guide rails 5*a* and 5*b* is parallel to the width direction of the car 6 when viewed from directly above. In addition, a straight line that connects centers of the counterweight guide rails 8*a* and 8*b* is parallel to the depth direction of the car 6 (a vertical direction in FIG. 4) when viewed from directly above.

The first car suspending sheave 7*a* is disposed in front of the car guide rails 5*a* and 5*b* in the depth direction of the car 6. The second car suspending sheave 7*b* is disposed behind the car guide rails 5*a* and 5*b* in the depth direction of the car 6. Rotating shafts of the car suspending sheave 7*a* and 7*b* are parallel to each other and horizontal.

The car suspending sheaves 7*a* and 7*b* are disposed such that the suspending body 20 that passes between the car suspending sheaves 7*a* and 7*b* is inclined relative to the width direction of the car 6 when viewed from directly above. In addition, the suspending body 20 that passes between the car suspending sheaves 7*a* and 7*b* intersects the straight line that connects the centers of the car guide rails 5*a* and 5*b* when viewed from directly above.

Figure 2:
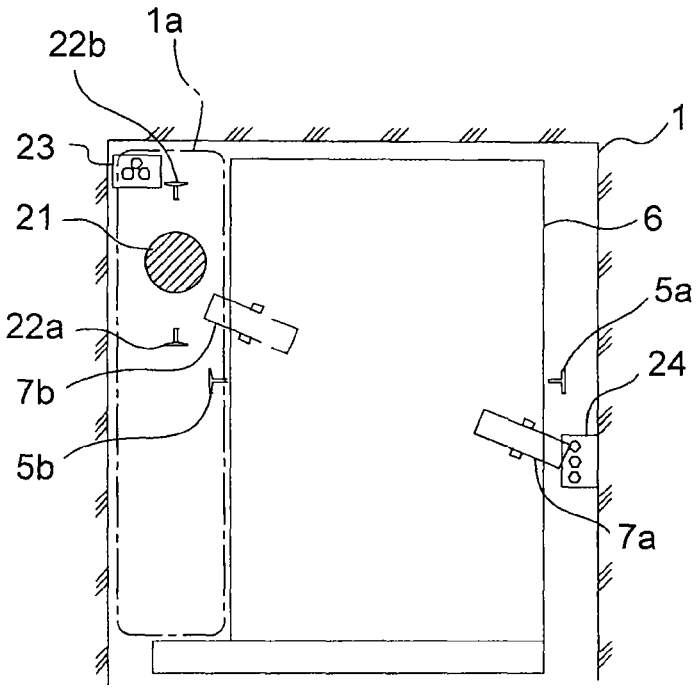
FIG. 2 is a plan that shows a general layout of major equipment in the elevator according to Embodiment 1 before refurbishment.

Next, an elevator refurbishing method according to Embodiment 1 will be explained. FIG. 2 is a plan that shows a general layout of major equipment in the elevator according to Embodiment 1 before refurbishment (a hydraulic elevator).

The hydraulic jack 21 is installed in a region of the equipment installation zone 1*a* behind the second car guide rail 5*b* (at the back when viewed from a landing). First and second upper portion return sheaves (not shown) are disposed on an upper portion of the hydraulic jack 21. The first and second upper portion return sheaves are moved vertically by the hydraulic jack 21.

A pair of hydraulic jack rails 22*a* and 22*b* that guide the vertical movement of the first and second upper portion return sheaves are installed on two sides of the hydraulic jack 21 so as to be parallel to each other and vertical. A hydraulic jack rope fastener portion 23 and a lower portion return sheave (not shown) are disposed on a lower portion of the hydraulic jack 21. An upper portion rope fastener portion 24 is disposed on the rope fastener beam in an upper portion of the hoistway 1.

The car 6 is suspended inside the hoistway 1 by a plurality of pre-refurbishment ropes (not shown). The pre-refurbishment ropes have: first end portions that are connected to the upper portion rope fastener portion 24; and second end portions that are connected to the hydraulic jack rope fastener portion 23. The pre-refurbishment ropes are wound sequentially from near the first end portions around the car suspending sheaves 7*a* and 7*b*, the first upper portion return sheave, the lower portion return sheave, and the second upper portion return sheave, and extend to the hydraulic jack rope fastener portion 23.

A period of refurbishing work according to Embodiment 1 is divided into a preparatory construction period and a continuous outage period. It is not necessary to stop operation of an existing hydraulic elevator continuously in the preparatory construction period. The continuous outage period is a period in which operation of both the existing and newly installed elevators is impossible.

Figure 3:
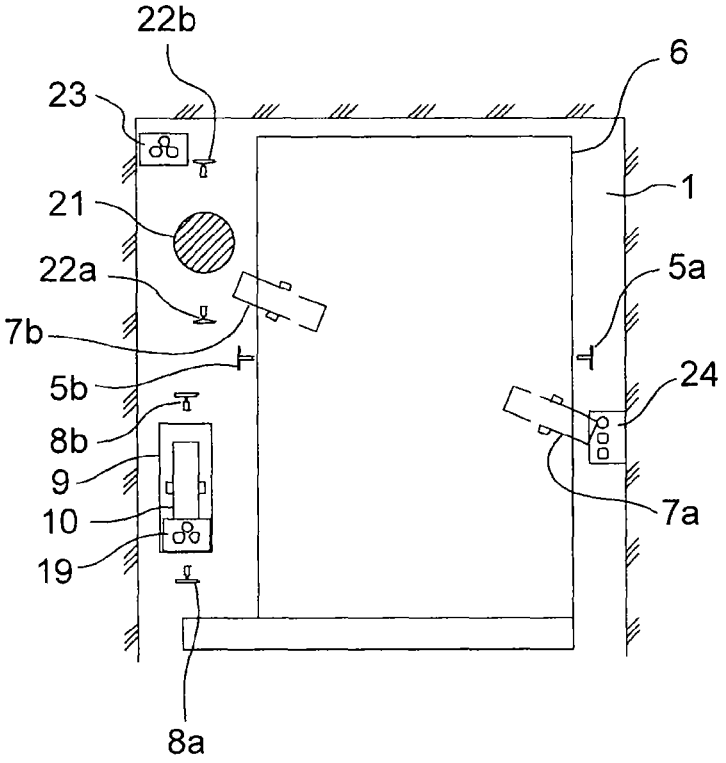
FIG. 3 is a plan that shows an intermediate state during refurbishment of the elevator in FIG. 2.

FIG. 3 is a plan that shows an intermediate state during refurbishment of the elevator in FIG. 2. The second base 3, the counterweight guide rails 8*a* and 8*b*, the counterweight 9, the upper portion supporting beam 15, the car return sheave 16, the counterweight return sheave 17, and the counterweight rope fastener portion 19, etc., are installed in the equipment installation zone 1*a* inside the hoistway 1 in the preparatory construction period. These items of equipment are installed in a region on an opposite side of the second car guide rail 5*b* from the hydraulic jack 21 in the depth direction of the car 6.

Thus, equipment that can be installed using vacant space inside the equipment installation zone 1*a* is installed while leaving the hydraulic jack 21, the hydraulic jack rails 22*a* and 22*b*, and the hydraulic jack rope fastener portion 23, etc., in position during the preparatory construction work, and it is not necessary to stop operation of the existing hydraulic elevator continuously.

When the preparatory construction work is completed, operational service of the hydraulic elevator is terminated, and the hydraulic jack 21, the hydraulic jack rails 22*a* and 22*b*, the hydraulic jack rope fastener portion 23, and the pre-refurbishment ropes are removed from the hoistway 1.

Figure 4:
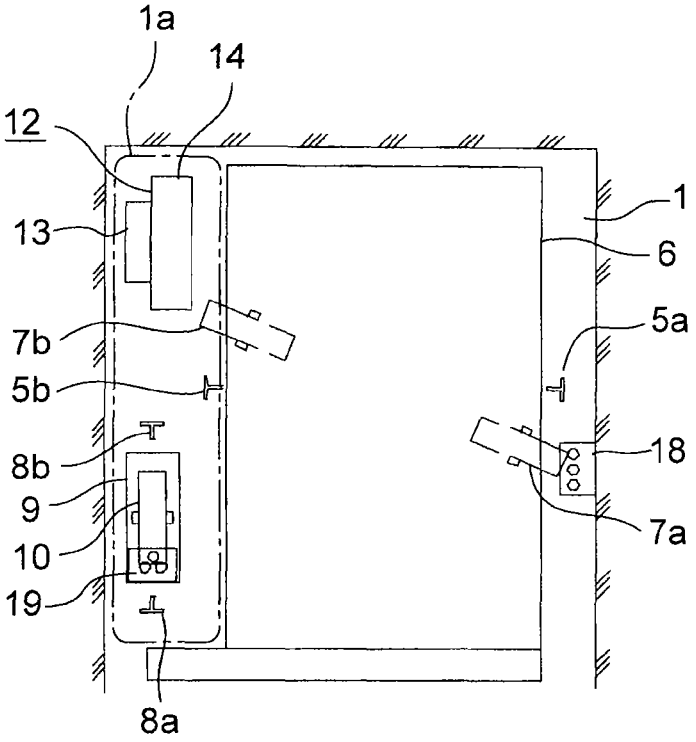
FIG. 4 is a plan that shows a state after refurbishment of the elevator in FIG. 3.

Then, as shown in FIG. 4, equipment such as the third base 4, the hoisting machine base 11, and the hoisting machine 12 is installed in a lower portion of the equipment installation zone 1*a* using space that is created by removal of the hydraulic jack 21, etc. The car rope fastener portion 18 is also installed in an upper portion inside the hoistway 1. Next, the suspending body 20 is disposed as shown in FIG. 1.

In an elevator refurbishing method of this kind, because it is not necessary to lift the hoisting machine 12, which constitutes a heavy load, to the upper portion of the hoistway 1, even if a lifting beam is installed, a small lifting beam is sufficient, reducing the scale of the work, and enabling labor time for the refurbishing work to be reduced. Furthermore, the refurbishing work can be carried out even if top portion dimensions of the hoistway 1 are small.

In addition, because most of the work is concentrated in the equipment installation zone 1*a*, labor time for the refurbishing work can also be reduced thereby.

Furthermore, because it is not necessary to stop operation of the hydraulic elevator continuously when installing the counterweight guide rails 8*a* and 8*b*, etc., the continuous outage period of elevator operation (the period during which the elevator cannot be used at all) can be shortened.

Because the upper portion supporting beam 15, the car return sheave 16, the counterweight return sheave 17, and the counterweight rope fastener portion 19 are supported by the counterweight guide rails 8*a* and 8*b*, it is not necessary to install a supporting column inside the hoistway 1, or to install a new supporting beam in the building, facilitating the refurbishing work.

In addition, because the suspending body 20 can be disposed in a horizontal layout at similar or identical positions to the pre-refurbishment ropes relative to the car 6, much of the existing equipment such as the car guide rails 5*a* and 5*b*, the car 6, the car suspending sheaves 7*a* and 7*b*, and other car peripheral equipment can be reused, enabling reductions in manufacturing and installation costs, shortening of work time, and reductions in waste to be achieved.

Embodiment 2

Figure 5:
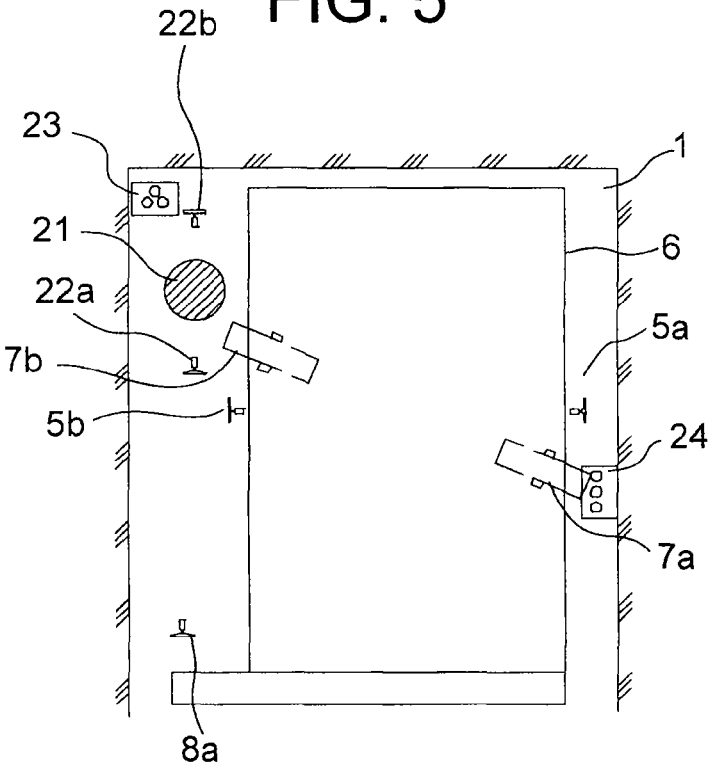
FIG. 5 is a plan that shows a general layout of major equipment in an elevator according to Embodiment 2 of the present invention partway through refurbishment.

Next, an elevator refurbishing method according to Embodiment 2 of the present invention will be explained. Configuration of the hydraulic elevator before refurbishment is similar or identical to that in FIG. 2. FIG. 5 is a plan that shows a general layout of major equipment in the elevator partway through refurbishment, and FIG. 6 is a plan that shows a state after refurbishment of the elevator in FIG. 5.

In Embodiment 2, the first counterweight guide rail 8*a*, which is the furthest of the counterweight guide rails 8*a* and 8*b* away from the second car guide rail 5*b*, is installed in a vacant space in the equipment installation zone 1*a* in the preparatory construction period. Other equipment for a machine-roomless elevator is installed inside the hoistway 1 in the continuous outage period after removing the hydraulic jack 21, etc.

Figure 6:
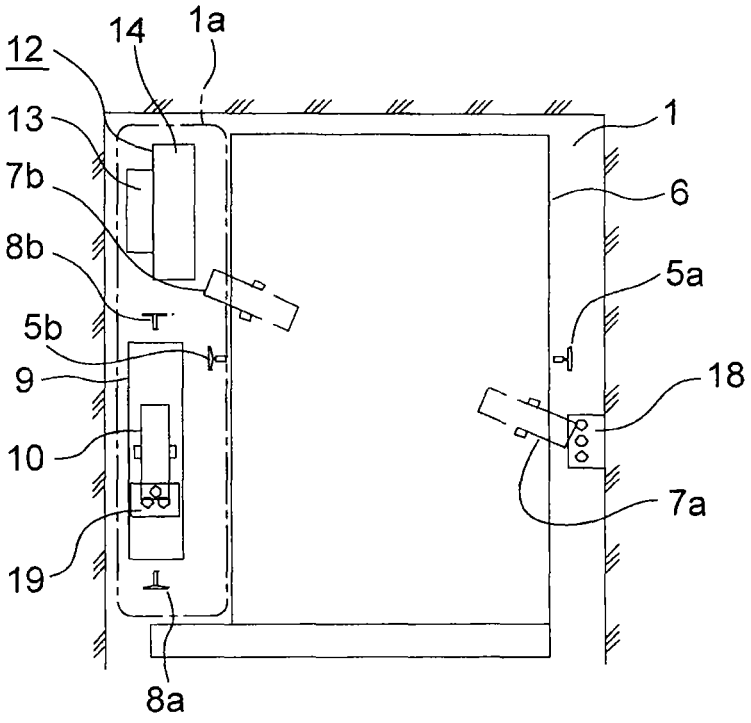
FIG. 6 is a plan that shows a state after refurbishment of the elevator in FIG. 5.

The second counterweight guide rail 8*b* is installed in a region behind the second car guide rail 5*b*, as shown in FIG. 6. The rest of the configuration and the refurbishing method are similar or identical to that of Embodiment 1.

In an elevator refurbishing method of this kind, because it is not necessary to lift the hoisting machine 12, which constitutes a heavy load, to the upper portion of the hoistway 1, similar effects to those in Embodiment 1 can be achieved.

Furthermore, because a large horizontal space can be acquired for the counterweight 9 compared to Embodiment 1, accommodation can be made even if the mass of the car 6 is large.

In addition, although the preparatory construction period is shorter, and the continuous outage period is longer, than in Embodiment 1, the continuous outage period can be shortened compared to when all of the equipment is removed together.

Furthermore, because the upper portion supporting beam 15, the car return sheave 16, the counterweight return sheave 17, and the counterweight rope fastener portion 19 are supported by the counterweight guide rails 8*a* and 8*b*, it is not necessary to install a supporting column inside the hoistway 1, or to install a new supporting beam in the building, facilitating the refurbishing work.

Because the suspending body 20 can be disposed in a horizontal layout at similar or identical positions to the pre-refurbishment ropes relative to the car 6, much of the existing equipment such as the car guide rails 5*a* and 5*b*, the car 6, the car suspending sheaves 7*a* and 7*b*, and other car peripheral equipment can be reused, enabling reductions in manufacturing and installation costs, shortening of work time, and reductions in waste to be achieved.

Moreover, in Embodiment 2, only the first counterweight guide rail 8*a* of the first and second counterweight guide rails 8*a* and 8*b* is installed in the equipment installation zone 1*a* during the preparatory construction period, but both of the counterweight guide rails 8*a* and 8*b* may alternatively be installed in vacant space inside the equipment installation zone 1*a*, and then the second counterweight guide rail 8*b* moved to widen the spacing between the counterweight guide rails 8*a* and 8*b* to a required size after removing the hydraulic jack 21, etc.

Embodiment 3

Figure 7:
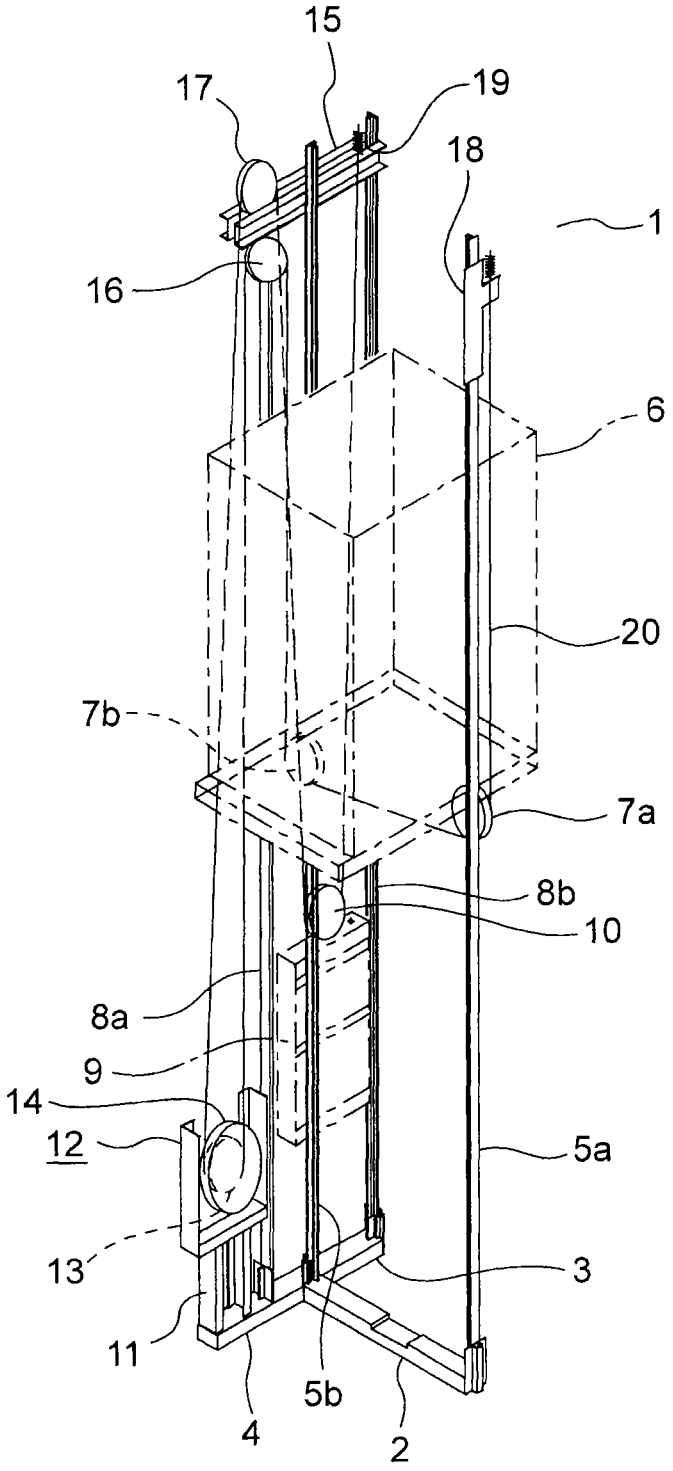
FIG. 7 is an oblique projection that shows a machine-roomless elevator that has been refurbished by a refurbishing method according to Embodiment 3 of the present invention.

Next, FIG. 7 is an oblique projection that shows a machine-roomless elevator that has been refurbished by a refurbishing method according to Embodiment 3 of the present invention. In Embodiment 3, when viewed from a landing side, a counterweight 9 and a counterweight rope fastener portion 19 are disposed at a back of an equipment installation zone 1*a*, and the hoisting machine 12, a car return sheave 16, and a counterweight return sheave 17 are disposed at a front of the equipment installation zone 1*a*.

In addition, a first car suspending sheave 7*a* is disposed behind car guide rails 5*a* and 5*b* in a depth direction of a car 6. A second car suspending sheave 7*b* is disposed in front of the car guide rails 5*a* and 5*b* in the depth direction of the car 6. The rest of the configuration is similar or identical to that of Embodiment 1.

Figure 8:
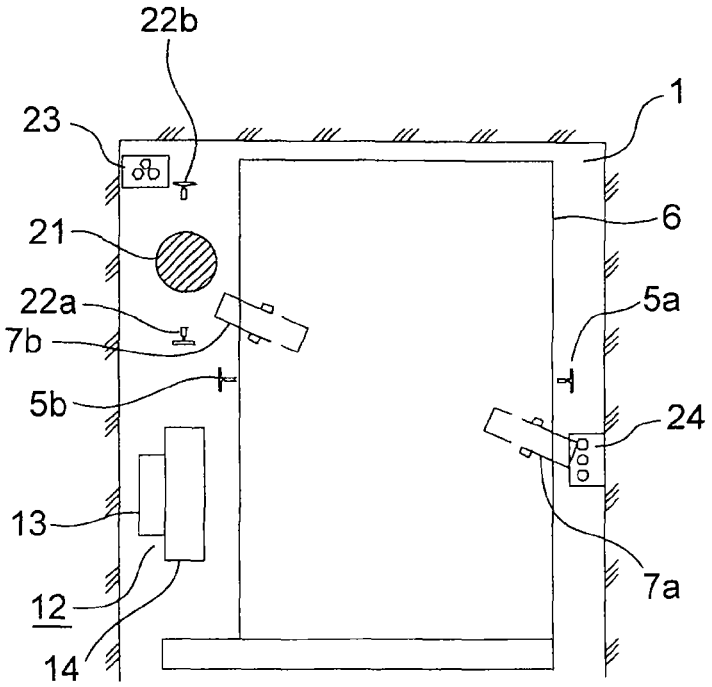
FIG. 8 is a plan that shows a general layout of major equipment in an elevator according to Embodiment 3 of the present invention partway through refurbishment.
Figure 9:
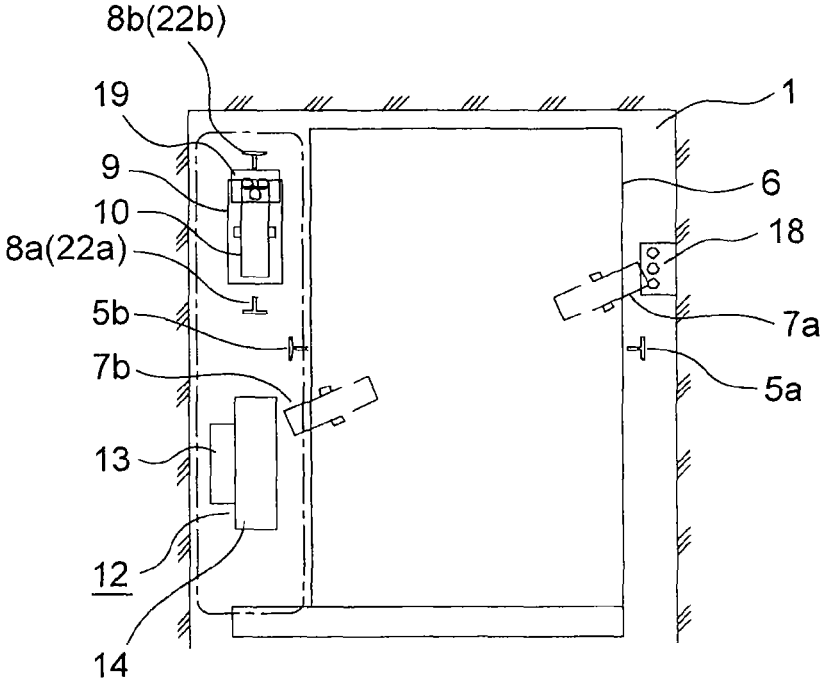
FIG. 9 is a plan that shows a state after refurbishment of the elevator in FIG. 8.

Next, an elevator refurbishing method according to Embodiment 3 of the present invention will be explained. Configuration of the hydraulic elevator before refurbishment is similar or identical to that in FIG. 2. FIG. 8 is a plan that shows a general layout of major equipment in the elevator partway through refurbishment, and FIG. 9 is a plan that shows a state after refurbishment of the elevator in FIG. 8.

In Embodiment 3, the third base 4, the hoisting machine base 11, and the hoisting machine 12 are installed in vacant space in the equipment installation zone 1*a* in the preparatory construction period. Other equipment for a machine-roomless elevator is installed in the equipment installation zone 1*a* in the continuous outage period after removing the hydraulic jack 21, etc., using space that is created by removal of the hydraulic jack 21, etc. Furthermore, the mounted positions of the car suspending sheaves 7*a* and 7*b* on the car 6 are modified, or the existing car suspending sheaves 7*a* and 7*b* are removed and new car suspending sheaves 7*a* and 7*b* are mounted to a lower portion of the car 6.

In addition, with regard to the counterweight guide rails 8*a* and 8*b*, the hydraulic jack rails 22*a* and 22*b* are used as the counterweight guide rails 8*a* and 8*b*, or the hydraulic jack rails 22*a* and 22*b* are removed, and new counterweight guide rails 8*a* and 8*b* are installed. The rest of the refurbishing method is similar or identical to that of Embodiment 1.

In an elevator refurbishing method of this kind, because it is not necessary to lift the hoisting machine 12, which constitutes a heavy load, to the upper portion of the hoistway 1, similar effects to those in Embodiment 1 can be achieved.

Because the hoisting machine 12 is simply installed in the vacant space during the preparatory construction period, the preparatory construction period can be shortened more than that of Embodiment 2. If the hydraulic jack rails 22*a* and 22*b* are used as the counterweight guide rails 8*a* and 8*b* after refurbishment, the continuous outage period can also be shortened compared to Embodiment 2, enabling the overall construction period to be further shortened.

Because the upper portion supporting beam 15, the car return sheave 16, the counterweight return sheave 17, and the counterweight rope fastener portion 19 are supported by the counterweight guide rails 8*a* and 8*b*, it is not necessary to install a supporting column inside the hoistway 1, or to install a new supporting beam in the building, facilitating the refurbishing work.

Much of the existing equipment such as the car guide rails 5*a* and 5*b*, the car 6, and other car peripheral equipment can be reused, enabling reductions in manufacturing and installation costs, shortening of work time, and reductions in waste to be achieved.

Moreover, in Embodiment 3, if spacing between the first and second counterweight guide rails 8*a* and 8*b* of the machine-roomless elevator after refurbishment is large, and the second counterweight guide rail 8*b* is installed in vacant space in the hydraulic elevator before refurbishment, then the second counterweight guide rail 8*b* may be installed during the preparatory construction period.

During the preparatory construction period, both of the counterweight guide rails 8*a* and 8*b* may alternatively be installed in vacant space inside the equipment installation zone 1*a*, and then the first counterweight guide rail 8*a* moved to widen the spacing between the counterweight guide rails 8*a* and 8*b* to a required size after removing the hydraulic jack 21, etc.

In addition, in the refurbishing method according to Embodiments 1 through 3, the existing car guide rails 5*a* and 5*b*, car 6, car suspending sheaves 7*a* and 7*b*, etc., are not necessarily required to be reused in the refurbished elevator, and may be replaced as needed.

Furthermore, in Embodiments 1 through 3, the equipment installation zone 1*a* is on a side near the second car guide rail 5*b* inside the hoistway 1, but may alternatively be on a side near the first car guide rail 5*a*.

The refurbishing method according to the present invention can also be applied to elevators that have an arrangement of equipment in which the arrangement of equipment of Embodiments 1 through 3 is inverted in the depth direction of the car 6.

The invention claimed is:

1. An elevator refurbishing method in which a hydraulic elevator in which a hydraulic jack is installed in an equipment installation zone is refurbished into a machine-roomless elevator that uses a two-to-one (2:1) roping method that comprises a hoisting machine, a counterweight, and a pair of counterweight guide rails, the equipment installation zone being a region inside a hoistway on either a left side or a right side of a car when viewed from directly above, wherein the elevator refurbishing method includes steps of:

installing at least one guide rail from the pair of counterweight guide rails in the equipment installation zone while leaving the hydraulic jack in position;

removing the hydraulic jack from the hoistway;

installing the hoisting machine in a lower portion of the equipment installation zone using a space that is created by removal of the hydraulic jack; and installing a car return sheave and a counterweight return sheave on an upper portion of the counterweight guide rails.

2. The elevator refurbishing method according to claim 1, wherein the at least one counterweight guide rail is installed in a region on an opposite side of car guide rails from the hydraulic jack in a depth direction of the car.

3. The elevator refurbishing method according to claim 1, wherein both of the pair of counterweight guide rails are installed in the equipment installation zone while leaving the hydraulic jack in position.

4. The elevator refurbishing method according to claim 1, wherein a first of the pair of counterweight guide rails is installed in the equipment installation zone while leaving the hydraulic jack in position, and a second is installed in the equipment installation zone after removal of the hydraulic jack.

5. An elevator refurbishing method in which a hydraulic elevator in which a hydraulic jack and a pair of hydraulic jack rails are installed in an equipment installation zone is refurbished into a machine-roomless elevator that uses a two-to-one (2:1) roping method that comprises a hoisting machine, a counterweight, and a pair of counterweight guide rails, the equipment installation zone being a region inside a hoistway on either a left side or a right side of a car when viewed from directly above, wherein the elevator refurbishing method includes steps of:

installing the hoisting machine in a lower portion of the equipment installation zone while leaving the hydraulic jack in position;

removing the hydraulic jack from the hoistway; and using the hydraulic jack rails as the counterweight guide rails, disposing the counterweight between the hydraulic jack rails, and installing a car return sheave and a counterweight return sheave on an upper portion of the hydraulic jack rails.

6. The elevator refurbishing method according to claim 5, wherein the hoisting machine is installed in a region on an opposite side of car guide rails from the hydraulic jack in a depth direction of the car.

7. An elevator refurbishing method in which a hydraulic elevator in which a hydraulic jack is installed in an equipment installation zone is refurbished into a machine-roomless elevator that uses a two-to-one (2:1) roping method that comprises a hoisting machine, a counterweight, and a pair of counterweight guide rails, the equipment installation zone being a region inside a hoistway on either a left side or a right side of a car when viewed from directly above, wherein the elevator refurbishing method includes steps of:

installing the hoisting machine in a lower portion of the equipment installation zone while leaving the hydraulic jack in position;

removing the hydraulic jack from the hoistway;

installing the counterweight guide rails in the equipment installation zone, and disposing the counterweight between the counterweight guide rails, using a space that is created by removal of the hydraulic jack; and installing a car return sheave and a counterweight return sheave on an upper portion of the counterweight guide rails.

8. The elevator refurbishing method according to claim 7, wherein the hoisting machine is installed in a region on an opposite side of car guide rails from the hydraulic jack in a depth direction of the car.

* * * * *